US005910265A

United States Patent [19]

Baker et al.

[11] Patent Number: 5,910,265

[45] Date of Patent: Jun. 8, 1999

[54] ELECTRIC RANGE AND A REVERSIBLE ELEMENT THEREFOR

[75] Inventors: Richard L. Baker, Lewisburg, Ohio; Bernard J. Brotzki, Broken Arrow, Okla.

[73] Assignee: Whirlpool Corporation, Benton Harbor, Mich.

[21] Appl. No.: 08/785,682

[22] Filed: Jan. 21, 1997

Related U.S. Application Data

[ 60] Provisional application No. 60/010,437, Jan. 23, 1996.

[51] Int. Cl.[6] ..... H05B 3/68; F27D 11/00

[52] U.S. Cl. ..... 219/454; 219/415

[58] Field of Search ..... 219/454, 415, 219/416, 417, 418; 99/339, 340

[56] References Cited

U.S. PATENT DOCUMENTS

| | | | |
|---|---|---|---|
| 2,025,252 | 12/1935 | Stencell | 219/416 |
| 2,416,645 | 2/1947 | Rutenber | 219/416 |
| 2,519,051 | 8/1950 | Kirk | 219/416 |
| 2,527,566 | 10/1950 | Miller | 219/416 |
| 2,528,579 | 11/1950 | Clark | 219/416 |
| 2,569,753 | 10/1951 | Fry | 219/416 |
| 2,624,826 | 1/1953 | Cunningham | 219/416 |
| 2,630,518 | 3/1953 | Brehm | 219/416 |
| 2,664,493 | 12/1953 | Weyrick | 219/416 |
| 2,709,215 | 5/1955 | Miller | 219/416 |
| 2,719,906 | 10/1955 | Fry | 219/416 |
| 2,761,053 | 8/1956 | Schneider | 219/416 |
| 2,764,665 | 9/1956 | Walkoe | 219/416 |
| 2,772,341 | 11/1956 | Lewis et al. | 219/416 |
| 3,316,389 | 4/1967 | Markowitz | 219/454 |
| 3,982,096 | 9/1976 | Dills | 219/403 |

*Primary Examiner*—Teresa Walberg
*Assistant Examiner*—Sam Paik
*Attorney, Agent, or Firm*—Joel M. Van Winkle; Robert O. Rice; Thomas A. Schwyn

[57] ABSTRACT

The invention is an electric range with a reversible electrical element. When the electric element is positioned in its non-reversed position, it can be used as a normal electric element for traditional cooking. When the reversible element is positioned in the reversed position, the electric element can be used as a slow cooker.

18 Claims, 2 Drawing Sheets

ELECTRIC RANGE AND A REVERSIBLE ELEMENT THEREFOR

This application claims the benefit of U.S. Provisional Application No. Ser. No. 60/010,437 filed on Jan. 23, 1996.

BACKGROUND OF THE INVENTION

1. Field of the Invention

The invention relates to an electric range, and, more specifically, to a reversible element for the electric range wherein in a normal, non-reversed position the element is used as a normal cooking element and in the reverse position the element can be used as a slow cooker.

2. Description of the Related Art

The use of slow cookers, such as crock pots, has long been known as a preferred device and method for cooking certain foods, such as stews and the like. Typically, the slow cooker is a separate or stand alone appliance designed to be positioned on a counter top within the kitchen. However, for convenience, there have been several attempts to incorporate a slow cooker with in an electric range.

All of the previous attempts to incorporate a slow cooker within an electric range have focused on using the cooking element (an electric element, which is plugged into an electrical socket) as the heat source for the slow cooker. These previous attempts further include means to vertically adjust the position of the electric element and the plug/socket with respect to the cook top of range. Often, the vertically adjustable electric element is in combination with a deep well casing or housing in which the element resides and into which a typical pan or crockery piece is placed to create a deep well or slow cooker.

In most cases, the electric element can function as a normal electric element in a range when it is in its normal position. To convert the electric element to a slow cooker, the position of the electric element is typically lowered vertically into the body of the range where it rests on supports provided by the deep well housing. In some cases, the deep well housing is permanently affixed to the range and in other cases, the deep well housing is removable and must be inserted into the recess for the cooking element prior to the lowering of the element. Examples of these combination electric ranges and slow cookers can be found in the following U.S. Pat. No. 2,569,753, issued Oct. 2, 1951; U.S. Pat. No. 2,624,826, issued Jan. 6, 1953; U.S. Pat. No. 2,664,493, issued Dec. 29, 1953; U.S. Pat. No. 2,709,215, issued May 24, 1955; U.S. Pat. No. 2,719,906, issued Oct. 4, 1955; U.S. Pat. No. 2,764,665, issued Sep. 25, 1956; and U.S. Pat. No. 2,772,341, issued Nov. 27, 1956.

Generally, most of the previous attempts to combine a slow cooker with an electric range have resulted in a workable solution that was unfortunately extremely inconvenient for the user to switch from the normal cooking element to a slow cooker.

SUMMARY OF THE INVENTION

The invention addresses this inconvenience by providing an electric range with a reversible element, which in the normal position can be used as a standard cooking element and in the reverse position can be used as a slow cooker. Typically, the electric range has a range top with multiple cooking elements. At least one of the cooking elements is a slow cooker. The electric elements generally comprise an electric coil and a plug which is received within a socket disposed within the electric range. The electric coil of the slow cooker element is reversible so that when it is in a normal, non-reversed, position, the electric coil is disposed near the range top for normal cooking and when it is in a reversed position, the electrical coil is disposed away from the cook top for slow cooking.

Preferably, the electrical coil has a planar portion that is rotated approximately 180° when the electric coil is moved between the normal and reverse positions. Also, the plug can be received in the socket in either a first and second positions, which correspond to the electric coil being in the normal and reversed positions. The electric coil may also include a connecting portion extending from the periphery of the planar portion to the plug to connect the planar portion of the electric coil with the plug. The connecting portion can be L-shaped, with the first leg being approximately perpendicular to the planar portion and the second portion being approximately parallel to the planar portion.

DETAILED DESCRIPTION OF THE PREFERRED EMBODIMENTS

Figure 1:
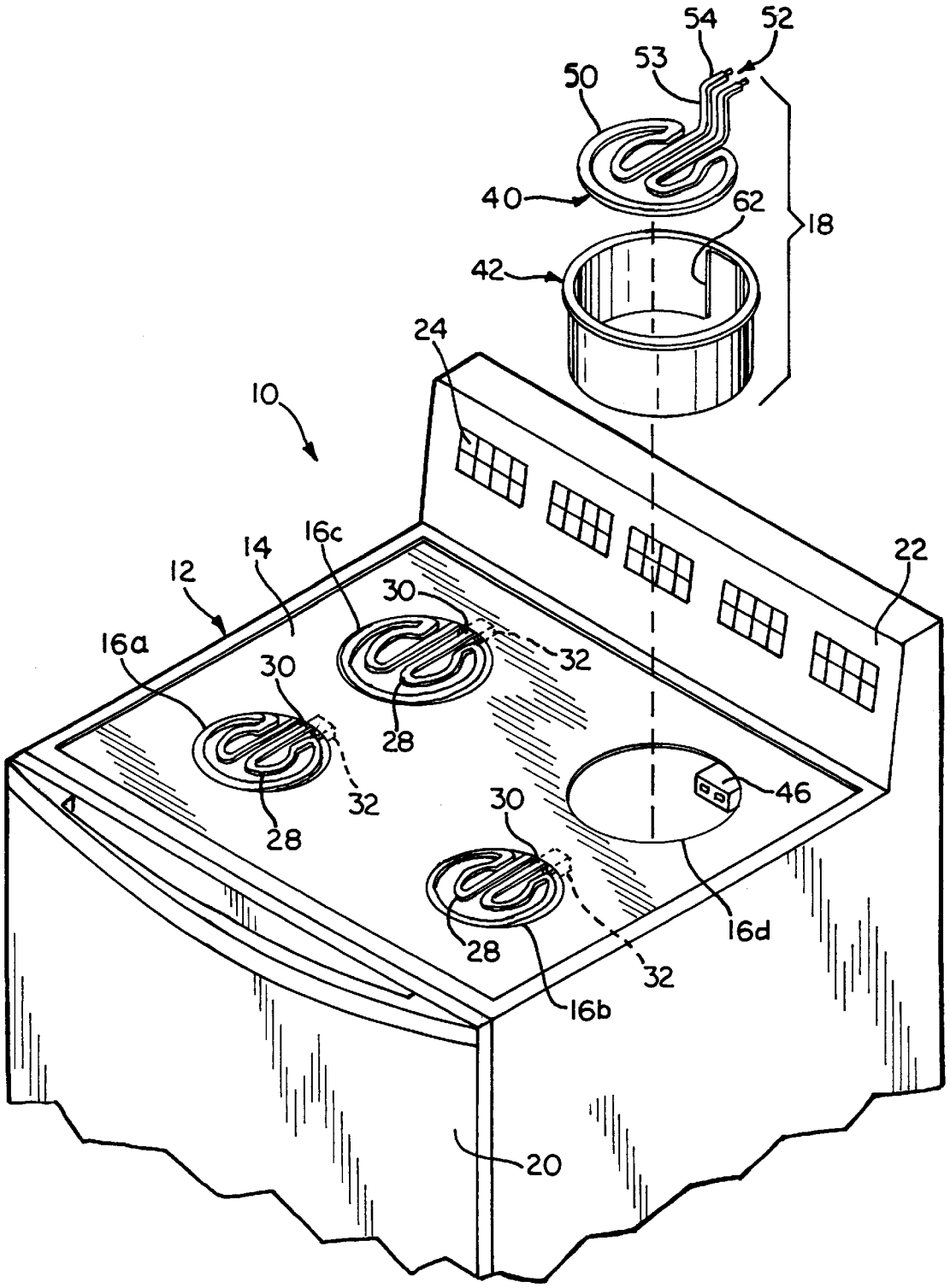
FIG. 1 is an exploded perspective view of the electric range with a reversible element according to the invention and further including an optional insulation ring.

FIG. 1 illustrates an electric range 10 according to the invention. As is typical in electric ranges, electric range 10 comprises a cabinet 12 having a cook top 14 on which is disposed multiple cooking elements 16 and the cabinet 12 further includes an oven door 20, which provides access to an oven. Also, a control panel 22 extends from the cabinet 12 at the rear of the cook top 14 and includes a variety of user input devices 24 for controlling the operation of the cooking elements 16 and the oven.

The cooking elements 16*a–c* are typical in that they comprise an electric coil 28 having a plug 30, which is received in a socket 32 disposed within the cabinet 12 below the cook top 14. Generally, the electric coils 28 comprise multiple elongated metal strips that are bent in a planar circular shape. Terminal ends of the elongated metal strips extend down and away from the planar portion and are received within the socket 32.

The cooking element 16*d* is generally similar to cooking elements 16*a–c* except that it can function as a normal cooking element and a slow cooker according to the invention. The cooking element 16*d* comprises a reversible electric coil 40 and an optional insulation ring 42, which surrounds the reversible coil 40 to prevent the escape of heat when the reversible coil 40 is used as a slow cooker. The reversible coil 40 also has a plug 44, which is inserted into a socket 46, connected to a source of electrical power.

Figure 2:
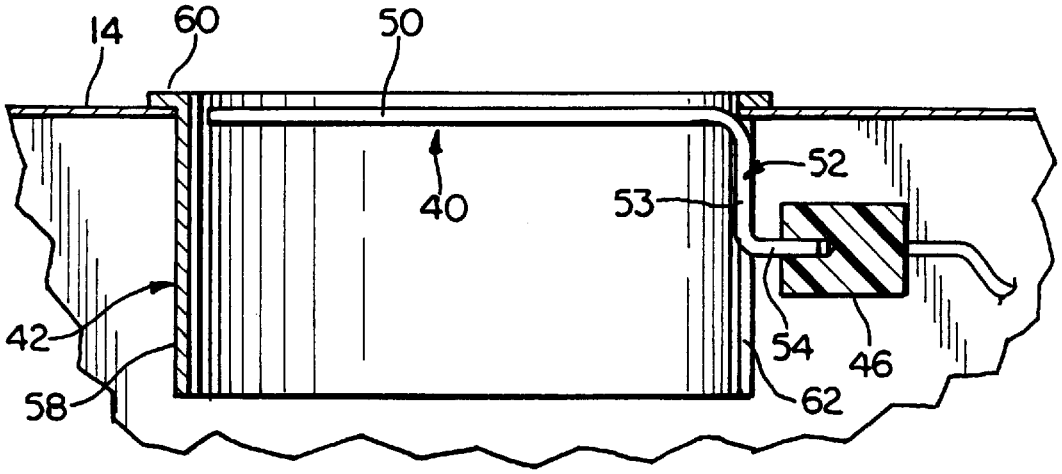
FIG. 2 is a partial sectional view of the assembled reversible element of FIG. 1 shown in the normal position and with the insulation ring.

Referring to FIG. 2, the reversible coil 40 is shown in a normal, non-reversed, position and in greater detail. The reversible coil 40 comprises a planar portion 50, which is approximately at the same height with respect to the cook top 14 as the other electric elements 28 when the reversible coil 40 is in the normal position. The planar portion 50 provides a suitably flat surface on which a pan or other cooking container can be positioned during cooking. The reversible coil 40 further comprises an L-shaped plug 52 having an extension portion 53 and a terminal 54. The terminal 54 is received in the socket 46, preferably by a pressure fit between the terminal 54 and the socket 46.

The reversible coil 40 preferably is formed from a single elongated strip of electrically resistant material, such as metal, which is bent in a tortuous path to define the planar portion 50 and the L-shaped plug 52 with its extension portion 53 and terminal 54. As illustrated in the preferred embodiment, the extension portion 53 and terminal are paired ends of the elongated strip. However, the paired ends could easily be a single end by selecting a suitable shape. Therefore, the extension portion 53 and the terminal 54 are referred to in the singular with the understanding it equally applies to an elongated strip with one or more ends. Further, it is important to the invention that the extension of the reversible coil 40 does not substantially extend into the interior of the planar portion as defined by its periphery, and preferably extends away from the periphery of the planar portion so that the extension 53 does not interfere with the positioning of a pan on either side of the planar portion.

Figure 3:
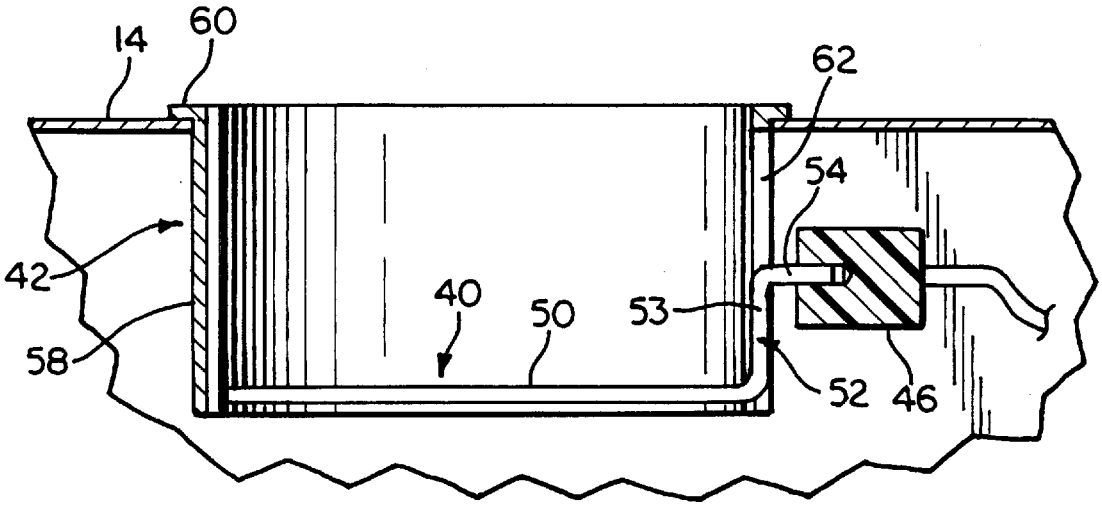
FIG. 3 is a partial sectional view of the assembled reversible element of FIG. 1 in the reverse position and with the insulation ring.

Referring to FIG. 3, the reversible electrical coil is shown in the reverse position and in combination with the insulation ring. The insulation ring 42 has a generally cylindrical body 58, which is open at both ends and an annular lip 60 at the upper end. A slot 62 is formed in the generally cylindrical body 58 through which the reversible electrical coil 40 passes.

Preferably, the reversible electrical coil 40 is shaped so that the connecting extension does not extend beyond the inner wall of the cylindrical body 58 of the insulation ring. By doing so, the maximum amount of space is saved for a pan or the like and the reversible electrical coil does not interfere with the pan being inserted into the insulation ring 42 during deep well cooking.

In operation, to convert to the cooking element 16 to a deep well cooker 18, the user grasps the reversible electrical coil 40 and lifts upwardly to remove the terminal 54 of the plug from the socket 46. The user then rotates the planar portion 50 approximately 180° and inserts the terminal 54 into the socket 46 as it illustrated in FIG. 3. Because the terminal 54 is offset from the planar portion 50 by the extension 53, the planar portion is now displaced a substantial distance below the cook top 14, providing sufficient room for a pan to be positioned within the cook top and the insulation ring 42 to form the slow cooker Thus, it can be seen that the conversion from the normal cooking position of FIG. 2 to the deep well cooker of FIG. 3 is achieved simply and quickly by merely reversing the reversible element 40, which is an advantage over prior slow cookers that require the lowering of the entire cooking element, including the electric coil, plug and socket. The length of the extension 53 of the reversible coil 40 determines the distance that the planar portion 40 is disposed below the cook top 14. Thus, if very large pans are contemplated, the extension can be lengthened.

Although the invention is shown in combination with an insulation ring 42, it should be noted that it is not necessary to include the insulation ring 42 for the invention to function properly. The insulation ring 42 merely increases the efficiency of the deep well slow cooker 18 by reducing the amount of heat loss.

The invention provides a quick and easy solution to the problem of providing an electric range with a cooking element that can be used as either a normal cooking element or a slow cooking element. More importantly, the invention solves this problem in a unique and simple way by providing a reversible electrical coil that permits the conversion of the normal cooking element to a deep well cooker by merely removing, reversing, and reinserting the reversible cooking element.

We claim:

1. In an electric range having a range top with multiple cooking elements and one of the cooking elements being convertible such that it can function as a slow cooker and the cooking elements comprising an electric coil with a plug and a socket for receiving the plug, the improvement comprising:

a reversible electrical coil positionable in a normal, non-reversed, position where the electrical coil is disposed near the range top for normal cooking and in a reversed position where the electrical coil is disposed away from the cook top for use in slow cooking.

2. An electric range as claimed in claim 1, wherein the reversible electrical coil has a planar portion that is rotated approximately 180 degrees when the electrical coil is moved between the normal and reversed positions.

3. An electric range as claimed in claim 1, wherein the plug of the reversible electrical coil is received in the socket in a first position when the reversible electrical coil is in the normal position and in a second position when the reversible electrical coil is in the reverse position.

4. An electric range as claimed in claim 3, wherein the reversible electrical coil has a planar portion that is rotated approximately 180 degrees when the reversible electrical coil is moved between the normal and reversed positions.

5. An electric range as claimed in claim 4, wherein the plug of the reversible electrical coil is generally disposed outside the periphery of the planar portion so as not to interfere with the placing of cookery on the planar portion when the electrical coil is in either the normal or reversed positions.

6. An electric range as claimed in claim 5, wherein the plug of the reversible electric coil comprises an extension and a terminal, the extension extends away from the planar portion and is generally disposed outside of the periphery of the planar portion, and the terminal extends from the extension and is outside the periphery of the planar portion.

7. An electric range as claimed in claim 5, wherein the plug of the reversible electric coil is generally L-shaped with a first leg being approximately perpendicular to the planar portion and a second leg being approximately parallel to the planar portion.

8. An electric range as claimed in claim 7, wherein the reversible electrical coil comprises an electrically resistant elongated member having a first and a second end, the first and second ends define the first and second legs and the portion between the first and second ends being bent in a tortuous path to form the planar portion.

9. An electric range as claimed in claim 1, wherein the reversible electric coil is positioned below the cook top when the reversible electric coil is in the reversed position.

10. An electric range as claimed in claim 8, and further comprising an insulation ring surrounds the reversible electric coil.

11. An electric range as claimed in claim 1, wherein the reversible electric coil includes a planar portion and a plug, which is generally disposed outside the periphery of the planar portion so as not to interfere with the placing of cookery on the planar portion when the electrical coil is in either the normal or reversed positions.

12. An electric range as claimed in claim 11, wherein the plug comprises an extension and a terminal, the extension extends away from the planar and is generally disposed outside of the periphery of the planar portion, and the terminal extends from the extension and is outside the periphery of the planar portion.

13. An electric range as claimed in claim 11, wherein the plug is generally L-shaped with a first leg being approximately perpendicular to the planar portion and a second leg being approximately parallel to the planar portion.

14. An electric range as claimed in claim 11, wherein the reversible electrical coil comprises an electrically resistant elongated member having a first and a second end, the first and second ends define the first and second legs and the portion between the first and second ends being bent in a tortuous path to form the planar portion.

15. A reversible electric coil for an electric range having a range top having a socket for receiving the reversible electric coil, the reversible electric coil being convertible to function as a slow cooker and comprising:

a planar portion defining a surface on which a pan is disposed; and a generally L-shaped plug comprising an extension and a terminal, the extension extends away from and is generally positioned beyond the periphery of the planar portion, wherein the terminal is received within the socket at either a normal, non-reversed, position wherein the planar portion is disposed near the range top for normal cooking or the terminal is received within the socket in a reversed position wherein the planar portion is disposed below the cook top for slow cooking.

16. An electric range as claimed in claim 15, wherein the planar portion is rotated approximately 180 degrees when the reversible electrical coil is moved between the normal and reversed positions.

17. An electric range as claimed in claim 16, wherein the plug is generally L-shaped with a first leg forms the extension and is approximately perpendicular to the planar portion and a second leg forms the terminal and is approximately parallel to the planar portion.

18. An electric range as claimed in claim 17, wherein the reversible electrical coil comprises an electrically resistant elongated member having a first and a second end, the first and second ends define the first and second legs and the portion between the first and second ends being bent in a tortuous path to form the planar portion.

* * * * *